United States Patent [19]

Giese

[11] Patent Number: 4,894,038

[45] Date of Patent: Jan. 16, 1990

[54] FRISBEE DISK AND BALL DROP ASSEMBLY

[76] Inventor: Frederick F. Giese, 1012 Market St., P.O. Box 184, Monticello, Ill. 61856

[21] Appl. No.: 328,914

[22] Filed: Mar. 27, 1989

Related U.S. Application Data

[63] Continuation of Ser. No. 133,103, Dec. 14, 1987.

[51] Int. Cl.[4] ..... A63H 27/00

[52] U.S. Cl. ..... 446/46; 273/351

[58] Field of Search ..... 446/46–48, 446/51; 273/424, 425, 428, 351, 357, 355; 244/180, 137.1, 23 C, 12.2

[56] References Cited

U.S. PATENT DOCUMENTS

| | | | |
|---|---|---|---|
| 2,744,356 | 5/1956 | Killinger et al. | 273/424 X |
| 2,858,386 | 10/1958 | Bonner | 244/190 X |
| 4,077,155 | 3/1978 | Bruntmyer | 446/46 |
| 4,135,324 | 1/1979 | Miller | 273/424 X |
| 4,145,049 | 3/1978 | Papazian, Sr. | 273/351 |
| 4,262,911 | 4/1981 | Opresik et al. | 446/46 X |

FOREIGN PATENT DOCUMENTS

| | | | |
|---|---|---|---|
| 459318 | 9/1950 | Italy | 273/351 |

*Primary Examiner*—Mickey Yu
*Attorney, Agent, or Firm*—Ernest Kettelson

[57] ABSTRACT

A frisbee disk and ball drop assembly comprising a circular frisbee disk having a convex outer wall and an inner concave wall, and a ball drop assembly carried on the wall of the frisbee disk at its center for dropping a ball from the concave wall of the disk when in flight on command from a remote control transmitter operated by a person on the ground. An object is to see how close the ball can be dropped to a preselected target on the groung. The ball drop assembly includes a loading and discharge tube to carry a ball to be dropped therefrom, a pivotally mounted gate pivotable between an open and closed position to open and close the discharge aperture of the loading and discharge tube, an operating mechanism to pivot the gate between its open and closed positions, a power source to drive the operating mechanism, a control circuit to start and stop the power source and a receiver to receive a sound wave or radio wave signal from a remote transmitter and to energize the control circuit upon receipt of such signal. A convenient power source is one or more small dry cell batteries to power a small electric motor for driving the operating mechanism that opens and closes the discharge tube gate. A convenient control circuit includes solid state components such as an integrated circuit or discrete transistors with associated resistors and capacitors to provide amplified electrical power to operate the motor upon receipt of a signal from the sound wave or radio wave receiver. The components may be embedded in the wall of the frisbee disk.

11 Claims, 9 Drawing Sheets

FRISBEE DISK AND BALL DROP ASSEMBLY

PRIOR APPLICATIONS

This application is a continuation of prior application Ser. No. 133,103 filed December 14, 1987.

BACKGROUND OF THE INVENTION

This invention relates to the field of amusement devices and games which utilize an item that is thrown through the air, and in particular to those which carry a second item that separates from the first during flight.

Prior art devices of this kind include those described in the following United States patents.

U.S. Pat. No. 4,077,155 discloses a disk shaped aerodynamic toy which rotates as it is thrown through the air, having a second toy member carried on a threaded shaft secured by a nut which unscrews due to the rotation of the disk thereby releasing the second toy member for descent to the ground by way of a parachute attached to the second toy member.

U.S. Pat. No. 3,959,918 discloses a toy for throwing into the air comprising a diamond shaped base with a compartment in the center for a parachute. The toy is thrown up in th air with a spinning motion. When it reaches its apex and begins to descend, the flap doors of the compartment open by gravitational pull to release the parachute. The toy then floats back down to earth.

U.S. Pat. No. 3,855,728 discloses an aerodynamic toy which comprises a pair of disks, one nesting within the other. When thrown through the air the disks separate, the nested disk sailing more slowly so the person to whom thrown can catch both disks, the faster one first and then he can move wherever necessary to catch the second one.

U.S. Pat. No. 3,134,194 discloses a toy missile for elastically propelling into the air, comprising a multistage toy rocket which separates in flight to release a toy glider.

U.S. Pat. No. 2,744,356 discloses a toy described as a parachute carrying aerial disk. The toy is thrown into the air and when it starts to descend, a relatively heavy figure to which the parachute is attached pulls away from the disk drawing the parachute out and away from the disk for descent to the ground.

U.S. Pat. No. 1,362,894 discloses a toy comprising a bow and arrow in which the arrow has a canister carried at the tip with a doll-like figure and parachute therein. The arrow is shot into the air, a long string is connected at one end to a release mechanism in the canister while the other end is stepped on by the person who shoots the arrow. When the arrow and canister in flight reach the limit of the string, the release mechanism releases the doll-like figure and parachute for descent to the earth.

In these examples of prior art devices, release of the second carried item cannot be determined from a remote ground location after the first carrier item has been put in flight, as to just when and where the second carried item will be released. Such prior art devices are therefore limited in their use, and cannot for example be used in a game of skill to determine who can throw the first carrier item in a particular direction, and then at the exact moment release the second carried item, so it will fall on or close to a preselected target area.

The present invention is an improvement over the prior art in these respects. The carried item can be released from the carrier disk on command from a remote ground location at any point desired during flight. It can therefore be used not only by an individual himself to see how close he can come to dropping the ball on a preselected target but in a game of skill with others to see which one of the group can come closest to the target during a successive number of throws until enough points are achieved to win the game.

SUMMARY OF THE INVENTION

It is an object of the invention to provide a carrier item and a carried item for flight through the air, separation means to separate the carried item from the carrier item during flight, and remote control means to signal the separation means from a remote location to so separate the carried item from the carrier item and permit the carried item to drop to the ground.

It is an object of the invention to provide a carrier item and a carried item for flight through the air which can be hand thrown, separation means to separate the carried item from the carrier item during flight, and remote control means for the thrower to signal the separation means from a remote location to so separate the carried item from the carrier item and permit the carried item to drop to the ground.

It is an object of the invention to provide a Frisbee disk having a concave-convex wall and a ball carrying assembly carried on the concave side of the wall, and remote control discharge means to discharge a ball from said ball carrying assembly from a remote location while said Frisbee disk is in flight.

It is an object of the invention to provide a Frisbee disk having a concave-convex wall and a ball carrying assembly embedded in a thickened central portion of said wall, and remote control discharge means to discharge a ball from said ball carrying assembly from a remote location while said Frisbee disk is in flight.

It is an object of the invention to provide a Frisbee disk having a concave-convex wall, a thickened central portion of said wall, and a compartment in said thickened central portion to carry an item with said Frisbee disk while in flight.

It is an object of the invention to provide a Frisbee disk having a concave-convex wall wherein one side of said wall is concave and the opposite side is convex, the concave side having a greater radius than the convex side to provide a progressively thicker wall from the circumferential edge extending radially inward to the central axis of the disk for embedding items in the thickened central portion of said wall.

DESCRIPTION OF PREFERRED EMBODIMENT

Figure 1:
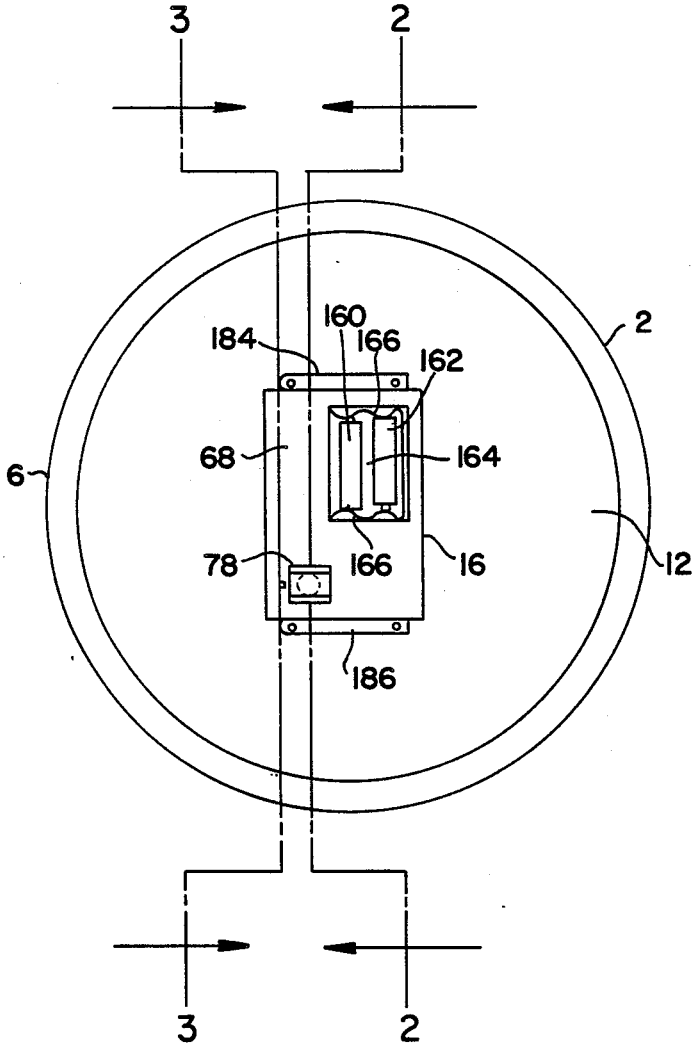
FIG. 1 is a bottom plan view of the concave side of a Frisbee disk having a ball carrying assembly in accordance with this invention on the concave side of the disk wall.

A Frisbee disk and ball drop in accordance with this invention includes a Fribee disk 2, having an arcuate wall 4 with a circular peripheral edge 6, a convex outer wall 8 and a concave inner wall 10, shaped to sail through the air when thrown with its convex outer wall 8 facing generally in an upward direction away from the earth and its concave inner wall 10 facing generally in a downward direction toward the earth.

The concave inner wall 10 defines and borders a relatively shallow dished cavity 12 opening at an open wall 14 bounded by the circular peripheral edge 6 of the frisbee disk 2.

A ball carrier assembly 16 is mounted within the dished cavity 12 and secured to the concave inner wall 10 axially aligned with its central axis 18.

The ball carrier assembly includes a housing 20, a battery operated motor 22 mounted therein and connected by a drive shaft 24 to a worm 26 which drives planar gear 28. The planar gear 28 is affixed to a driven shaft 30 supported for rotation by bearings 32 and 34.

A gate operating arm 36 is secured to the lower end portion of driven shaft 30 for rotation therewith, and for engagement with the projecting free end portion 38 of a pivotally mounted gate 40 pivotable on pin 42 between a gate open and a gate closed position. The gate 40 is normally biased to the gate closed position by a spring 44 connected to the opposite end 46 of the pivotally mounted gate 40. The forwardly facing side edge 48 of the gate 40 abuts against a ledge 50 when biased to the gate closed position, at which time the gate 40 is in registration with the discharge opening 52 of passageway or chamber 54 of loading tube 56 to block the ball 58 therein from being discharged from the tube 56.

Figure 4:
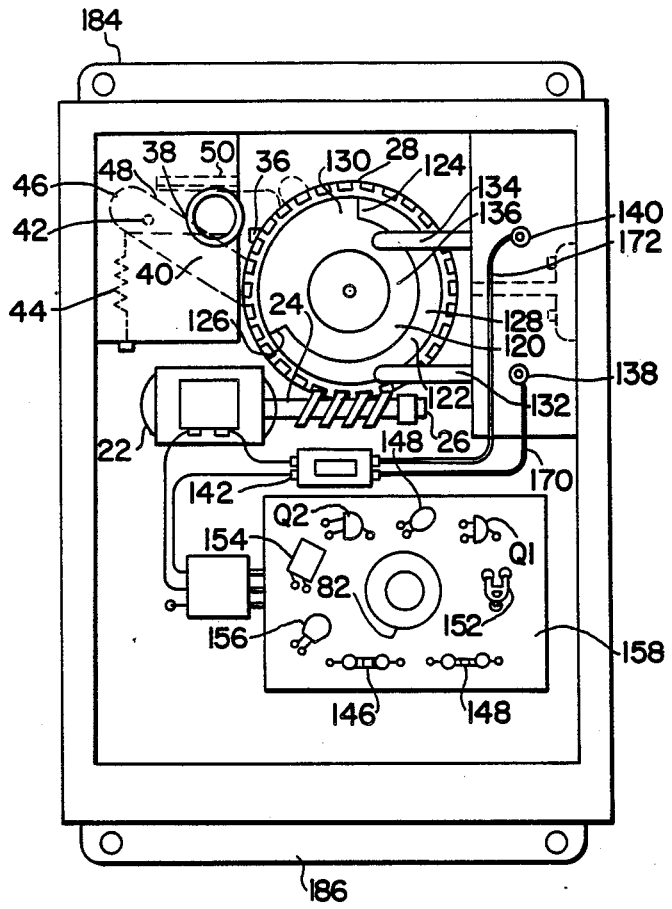
FIG. 4 is a plan view from the top of the ball carrying assembly in accordance with this invention, shown removed from the Frisbee disk.
Figure 5:
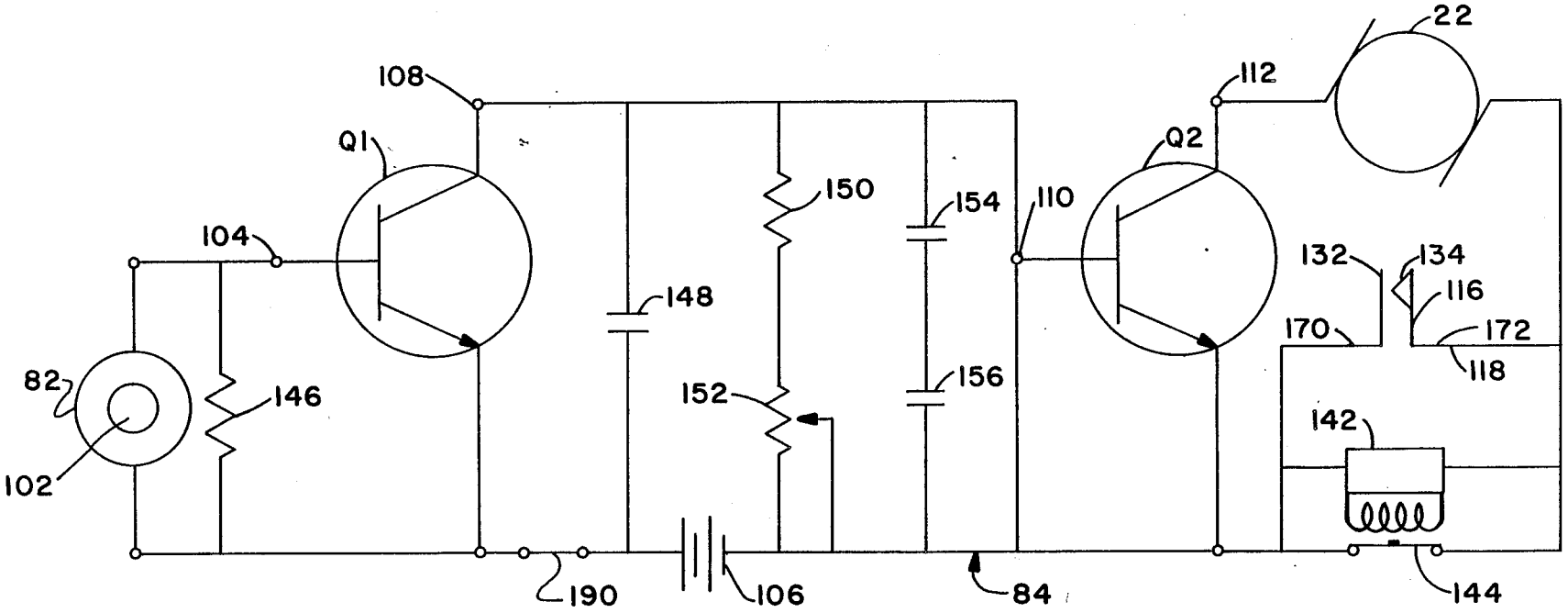
FIG. 5 is a schematic of the operating circuit for the ball discharge mechanism in accordance with this invention.
Figure 6:
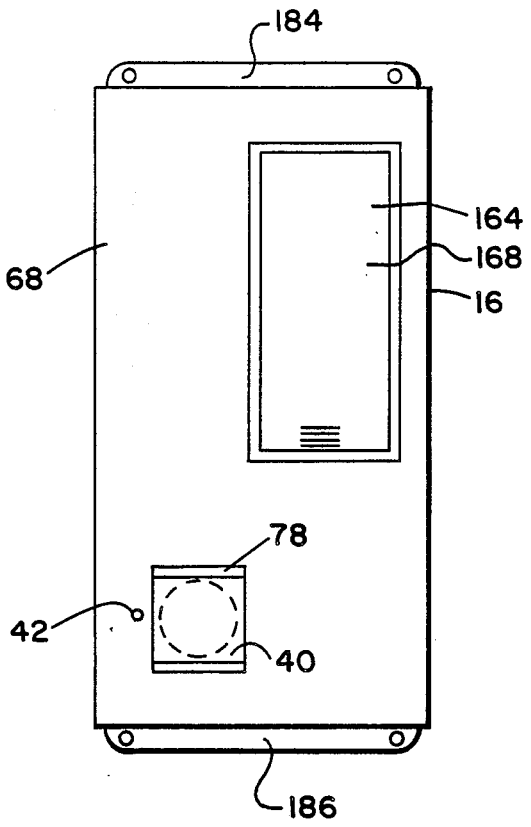
FIG. 6 is a bottom plan view of the housing for the ball carrying assembly in accordance with this invention.
Figure 7:
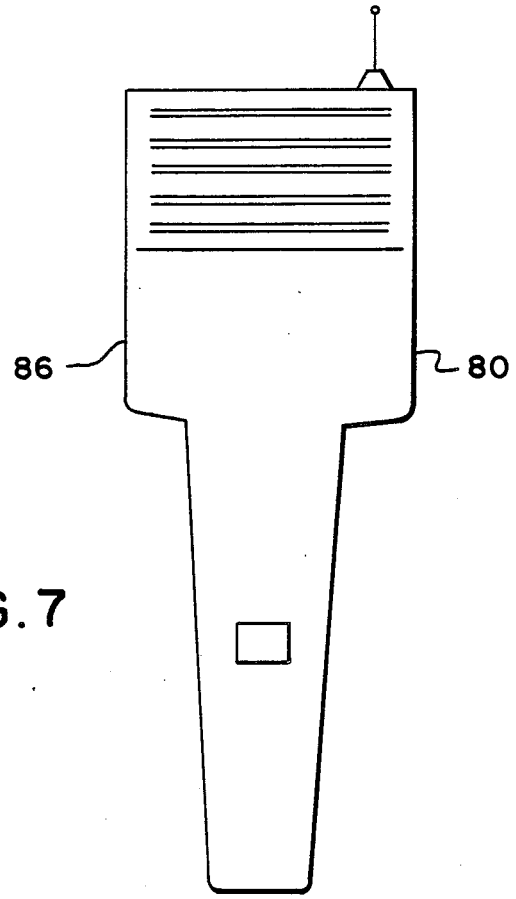
FIG. 7 is a top plan view of the hand operated sound wave transmitter for use with the remote controlled ball carrying assembly and discharge mechanism of this invention.
Figure 8:
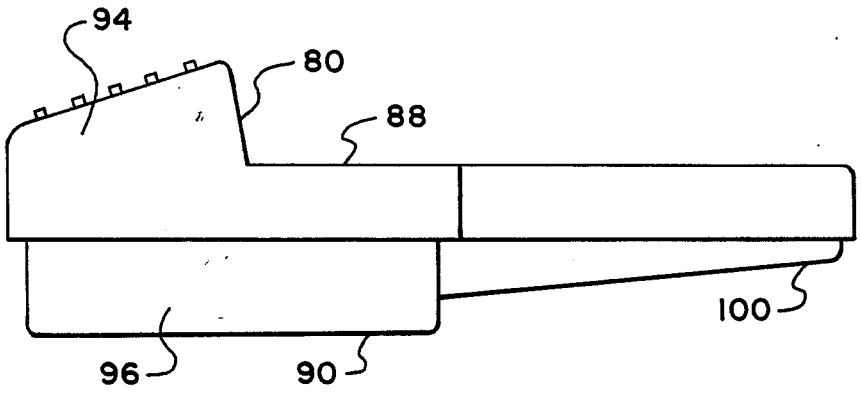
FIG. 8 is a side elevation view of the sound wave transmitter shown in FIG. 7.
Figure 9:
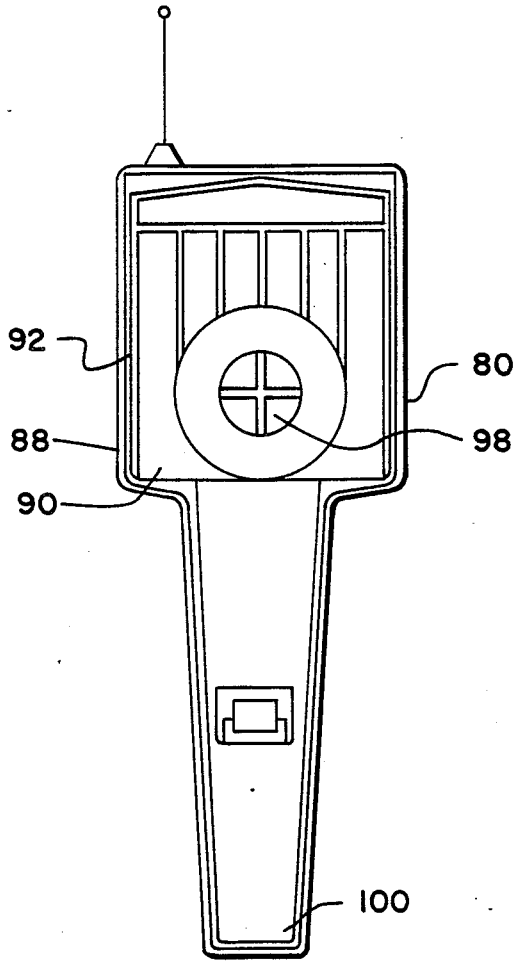
FIG. 9 is a bottom plan view of the sound wave transmitter shown in FIG. 7. .

The gate operating arm 36 extends outwardly from the driven shaft 30 far enough to engage the projecting free end 38 of the gate 40, when the planar gear 28 is driven in the counterclockwise direction as seen in FIG. 4. The pivotally mounted gate 40 is mounted within the housing 20 with its projecting free end 38 extending into the arcuate path of travel of the gate operating arm 36 when in the gate closed position. The gate 40 comprises an elongated plate having an upper surface 60 with a width dimension corresponding to that of the diameter of the discharge opening 52 of loading tube 56. A tubular sleeve bearing 62 extends from the lower surface 64 of the gate 40 terminating at a free end 66 bearing against the floor 68 of the housing 20. The sleeve bearing 62 is sufficiently long to position the upper surface 60 of the gate 40 far enough above the floor 68 to be immediately adjacent the discharge opening 52 of loading tube 56 to retain the ball 58 therein until the gate 40 is pivoted to the gate open position.

The discharge end 52 of loading tube 56 terminates at a platform 74 spaced apart above the floor 68 of housing 20 a sufficient distance to provide an operating chamber 76 for the gate 40 to pivot between the gate open and gate closed positions.

A floor opening 78 is provided in the floor 68 of housing 20 in registration with the discharge opening 52 of the loading tube 4 to permit the ball 58 to drop through the floor 68 when the gate 40 is pivoted to the gate open position enabling the ball 58 to drop from the discharge opening 52 of the tube 56.

The motor 22 is operated by a remote control mechanism comrprising a sound wave transmitter 80 and a sound wave receiver 82 which generates an electrical signal on the operating circuit 84 in which sound wave receiver 82 is connected within the housing 20 of ball carrying assembly 16.

The sound wave transmitter 80 comprises a hand held mechanism that produces a sound and generates sound waves of a frequency and intensity that can be sensed by the sound wave receiver 82 from a distance at least as great as that which a Frisbee disk can be thrown. The sound wave transmitter 80 includes a two part body 86 comprising an outer shell 88 and an insert 90 of substantially the same peripheral configuration but slightly smaller to be received in the cavity 92 of the outer shell 88. Each has a sound amplifying chamber, 94 and 96 respectively, with a sound producing metal membrane 98 sandwiched between in such a way that it produces a sound, and generates sound waves, when flexed. The insert 90 is mounted in the cavity 92 of outer shell 88 in such a way that its handle end 100 is normally biased outwardly but may be pressed inwardly thereby flexing the sound producing member 98 and generating the sound waves which generate an electrical signal in the sound wave receiver 82.

The operation of sound wave transmitters and receivers to generate an electrical signal is conventional, and their operation need not be explained in greater detail here.

A radio transmitter and receiver may also be used as the remote control and signal generating mechanism for use with this invention. The use of radio frequency waves for such purposes and how radio transmitters and receivers work is also well known and need not be repeated here.

The sound wave receiver 82 is a small component having a small cylindrical chamber 102 in which an electrical signal is induced upon receipt of sound waves generated by the sound wave transmitter 80. The sound wave receiver 82 is connected in operating circuit 84 to impose the signal generated on the base terminal 104 of NPN transistor Q1 whose emitter-base circuit is forward biased by battery pack 106. An amplified current flow is thus created from the collector terminal 108 of transistor Q1 to the base terminal 110 of transistor Q2, further amplifying current from the collector terminal 112 of transistor Q2 to drive the motor 22.

A limit switch 116 is provided in a disconnect circuit 118 to limit operation of motor 22 to the time needed to rotate planar gear 28 one revolution.

The operation of the limit switch is as follows. An electrically conductive circular copper plate 120 is secured to the upper surface 122 of the non-conductive planar gear 28, coaxially therewith, extending radially toward the circumferential edge of planar gear 28. An annular portion of the copper plate 120 is cut away from somewhat more than half of its outer circumferential edge along opposite edges 124 and 126, leaving an annular portion of the non-conductive planar gear 28 exposed. A non-conductive annular path 128 is thereby provided around somewhat more than half of the circumference of the planar gear 28. The annular continuation of such path is on the outer circumference edge portion of the circular copper plate 120, thereby providing an electrically conductive annular path 130 as the continuation of non-conductive annular path 128.

A leaf spring electrical contact arm 132 is positioned for continuous contact in the annular path comprising the non-conductive portion 128 and the conductive portion 130 as the planar gear 28 is rotated.

A second leaf spring electrical contact arm 134 is positioned for continuous contact in an annular path which is radially inward from the cut-away portion of circular copper plate 120 and which is a continuously conductive annular path 136.

The leaf spring contact arms 132 and 134 are connected to respective terminals 138 and 140 of the disconnect circuit 118 in which a relay 142 is connected to open switch 144, normally biased to the closed contact position, which when opened interrupts the operating circuit 84 and stops the motor 22. This occurs during each revolution of the planar gear 28. When leaf spring contact arm 132 is in contact with the non-conductive portion 128 of the annular path in which it is positioned on the upper surface of the planar gear 28, the disconnect circuit 118 is open, relay 142 is not energized, and switch 144 is in its normally biased closed contact position. A signal received by the sound wave receiver 82 and transmitted to transistor Q1 can then energize the operating circuit 84 causing amplified current to flow to operate the motor 22.

As the motor 22 begins to operate, it begins to rotate the planar gear 28 with leaf spring contact arm 132 in contact with non-condutive annular path 128 and leaf spring contact arm 134 in contact with continuously conductive annular path 136. As planar gear 28 continues its single rotation, the electrically conductive annular path 130 reaches leaf spring contact arm 132, whereby an electrical circuit is completed across the leaf spring contact arms 132 and 134 thereby closing the disconnect circuit 118 and energizing the relay 142. The normally closed switch 144 in the operating circuit 84 is thus caused to open, thereby interrupting the operating circuit and stopping the motor 22 before the planar gear 28 can begin a second revolution.

The arcuate length of the electrically conductive portion 128 of the annular path which is intermittently conductive and non-conductive is less than half the circumference of planar gear 28 and only long enough to permit the disconnect circuit 118 to energize relay 142 and hold switch 144 open a sufficient length of time to interrupt the operating circuit 84.

The control components of the operating circuit 84, including the sound wave capacitor 148, resistor 150, rheostat 152, capacitors 154 and 156 and transistor Q2, are mounted on a circuit board 158 within the housing 20 of ball carrier assembly 16. The operating circuit 84 is powered by the battery pack 106 comprising two conventional dry cell batteries 160 and 162, each 1.5 volts, 15 amp, size AA. The batteries are carried in the battery compartment 164 of housing 20, and connected to the operating circuit 84 by bus bars 166. Access to the battery compartment is by removing the compartment cover 168.

The disconnect circuit 118 comprising leaf spring contact arms 132 and 134, conductors 170 and 172, and relay 142 are also mounted within the housing 20 of the ball carrier assembly 16.

The loading tube 56 extends upwardly from its discharge end 52 and terminates at a loading end 174 received in an aperture 176 extending through the wall 4 of the frisbee disk 2, the loading end 174 of tube 56 having a loading aperture 178 opening to the outer convex wall 8 of the Frisbee disk 2. The ball 58 is placed in the loading tube 56 from the outer conex surface of the Frisbee disk, and the loading apeture 178 may then be closed by the closure cap 180.

The housing 20 and its operating components are mounted within the dished cavity 12 of the Frisbee disk 2 by screws 182 or other connecting devices securing the mounting tabs 184 and 186, which extend across each end of the housing 20, to the concave inner wall 10 of the Frisbee disk 2.

The Frisbee disk and ball drop in accordance with this invention may be used for amusement in a general sense, and may also be used in a contest or game to see who can drop the ball 58 closest to a selected target from a thrown Frisbee disk.

Operation of the Frisbee disk and ball drop in accordance with this invention is as follows. The ball 58 is placed in the loading chamber 54 of tube 56 and closure cap 180 is placed on the tube to close the loading aperture 178. The Frisbee disk 2 is then thrown into the air with one hand, convex wall 8 facing upwardly and concave wall 10 facing downwardly, and the sound wave transmitter 80 is held in the other hand ready to generate a sound wave signal when the Frisbee disk 2 has sailed to whatever location chosen for discharge of the ball 58.

At such time, the sound wave transmitter 80 is squeezed, pushing the insert 90 inwardly to flex the sounding producing metal membrane 98, thereby generating a sound wave which is transmitted to the sound wave receiver 82 in the housing 20 carried by the Frisbee disk 2. The receiver 82 thereupon generates an electrical signal which is transmitted to transistor Q1 causing amplified current to flow to the motor 22 as described above. The motor 22 rotates the planar gear 28 and the gate operating arm 36 connected for rotation with the shaft 30 to which planar gear 28 is secured. As the gate operating arm 36 rotates it engages the projecting free end portion 38 of the pivotally mounted gate 40 and pivots it to the gate open position, thereby opening the discharge aperture 52 of the loading tube 56 and discharging the ball 58 from the housing 20 and downwardly facing concave wall side of the disk 2. The ball 58 clears the Frisbee disk 2 and falls to the ground. With practice, a person can learn to make the ball hit near or on a selected target area by throwing the Frisbee disk a particular way and selecting exactly the right moment to discharge the ball.

After the ball has been discharged from the Frisbee disk, the planar gear 28 continues to be rotated by the motor 22 in its single revolution until the electrically conductive annular portion 130 of the copper plate 120 on the upper surface of planar gear 28 reaches leaf spring contact arm 132. At such time, an electrical circuit is completed across leaf spring contact arms 132 and 134 through the copper plate 120, thereby energizing relay 142 in the disconnect circuit 118 to open normally closed contact 144 in the operating circuit 84. The operating circuit 84 is thus interrupted and motor 22 stops before planar gear 28 has begun a second revolution.

When the planar gear 28 continues its rotation during the single revolution, the gate operating arm 36 rotates past its engagement with the free end portion 38 of the pivotally mounted gate 40, thereby releasing it to swing back to its gate closed position under the bias of spring 44. The discharge aperture 52 of the loading tube 56 is thus closed ready for reloading.

Figure 2:
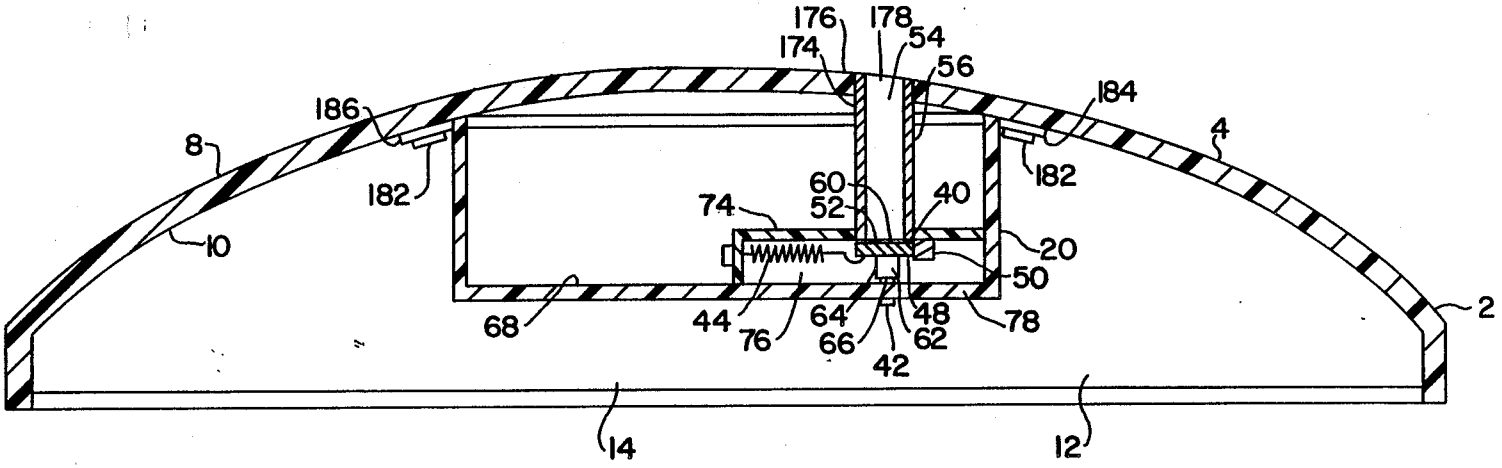
FIG. 2 is a section view taken on line 2—2 of FIG. 1.
Figure 3:
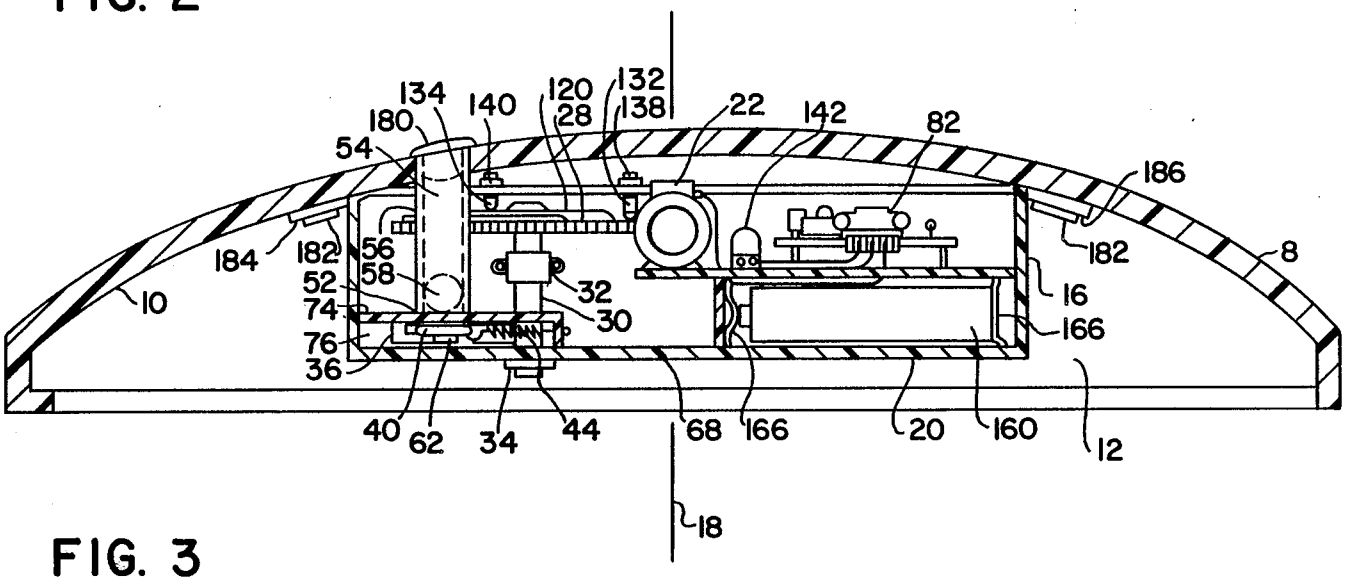
FIG. 3 is a section view taken on line 3—3 of FIG. 1.
Figure 10:
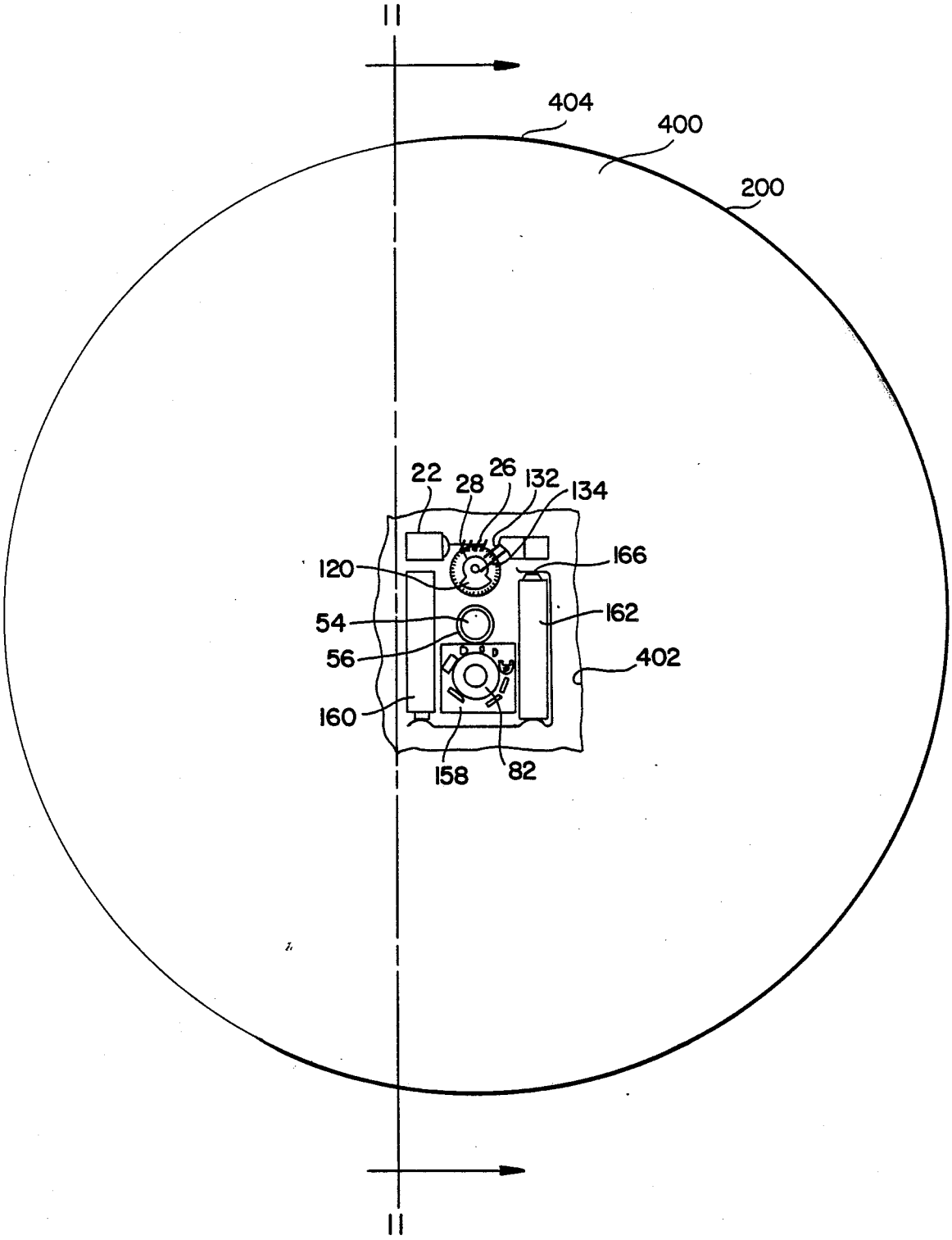
FIG. 10 is a top plan view of the convex side of a modified Frisbee disk in accordance with this invention, a portion in the center broken away to show the operating components of the ball carrying assembly and discharge mechanism operationally embedded in a thickened central portion of said modified Frisbee disk.
Figure 11:
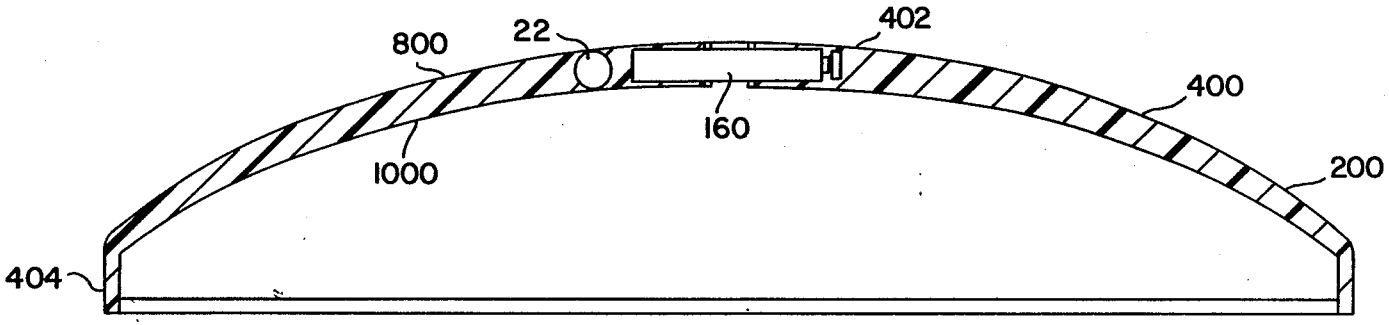
FIG. 11 is a section view taken on line 11—11 of FIG. 10.

The component parts of the ball carrier assembly 16 in accordance with this invention may be placed together more compactly than shown in FIGS. 2–4 of the drawings for purposes of being able to illustrate better. The receiver 82 and motor 22 have the largest cross-sectional dimension or thickness, and that dimension can be as small as one-half to three-quarter of an inch. If grouped closely together, the components can be mounted within a compartment no longer than three inches and no wider than two inches, with a depth no greater than one-half to three-quarters of an inch. Such compartment can be molded into the arcuate wall 4 of the Frisbee disk at its center, and the components themselves can be embedded in the plastic wall of the Frisbee disk if desired. FIGS. 10 and 11 illustrate an embodiment of this invention in which the compartment and some of the components themselves are embedded in the wall of a modified Frisbee disk 200.

The modified Frisbee disk 200 includes a substantially arcuate wall 400 having a thickened arcuate wall portion 402 at its center and gradually thinning toward its peripheral edge 404. The outwardly substantially convex wall portion 800 has a smaller radius than the inwardly facing substantially concave wall portion 1000. This disk construction makes it possible to place the ball carrier assembly in accordance with this invention within the wall of the Frisbee disk itself.

Figure 12:
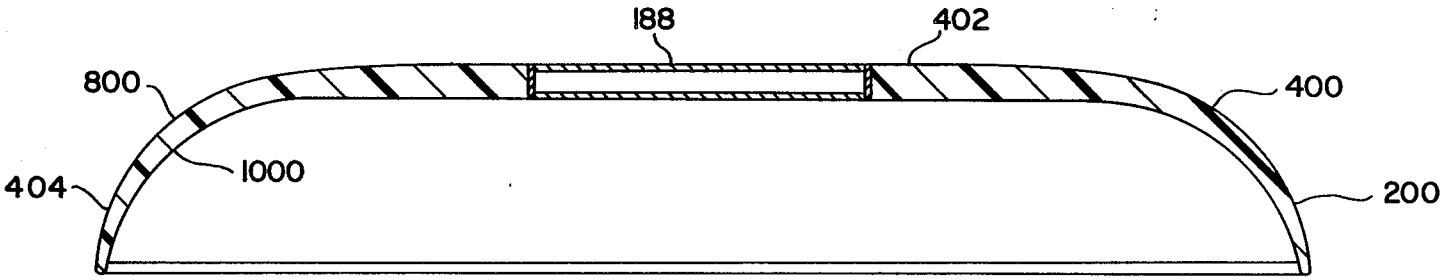
FIG. 12 is a section view of a modified Frisbee disk of the type shown in FIGS. 10 and 11, having a carrying compartment embedded in the thickened central portion thereof.

FIG. 12 is another illustration of a Frisbee disk for use with this invention. The disk shown in FIG. 12 is formed by providing the wall 400 with an arcuate cross-sectional configuration around the outer peripheral section, and then making the central portion of the disk substantially flat. The inner and outer surfaces of the arcuate outer peripheral section diverge as they extend radially inwardly from the peripheral edge 404 creating a gradually thicker wall until they reach the substantially flat central portion of the disk shown in FIG. 12. The inner and outer surfaces of the disk wall 400 then extend in substantially parallel planes, uniformly spaced apart, to provide the thickened wall portion 402 as shown in FIG. 12.

A box or other enclosure 188 may be embedded in the center of the thickened wall portion to carry such items as the ball carrying and remote control discharge assembly of this invention. Other items may be carried in such enclosure, such as battery powered lights, music boxes or sound emitting devices, and the like which enhance the entertainment and amusement characteristics of Frisbee disks.

An operating circuit disconnect switch 190 may be provided to disconnect the batteries 106 completely from the operating circuit 84 when the ball drop Frisbee disk as described herewin is not in use.

I claim:

1. An aerodynamic disk and carried member for flight through the air, in which said disk has an upwardly facing surface which faces generally upward and away from the earth during flight and a downwardly facing surface which faces generally downward and toward the earth during flight and a carried member carried by said disk during flight and separatable therefrom during flight, remote controlled separation means to separate said carried member from said disk on command during flight, and remote control transmitting means to command said separation means to separate said carried member from said disk during flight, wherein said remote controlled separation means includes a discharge chamber to hold said carried member, said discharge chamber including a discharge aperture for discharge of said carried member from said discharge chamber on command from said remote control means, wherein said remote controlled separation means includes retention and discharge means movable between an aperture closed and aperture open position to respectively retain said carried member in said discharge chamber when in said aperture closed position and discharge said carried member from said discharge chamber when in said aperture open position, wherein said remote controlled separation means includes operating means to move said retention and discharge means between said aperture closed and aperture open positions, power means to drive said operating means, and a remote control receiver to start said power means and initiate operation of said operating means, said remote control transmitting means including a remote control transmitter operable to transmit a signal to said remote control receiver, wherein said retention and discharge means includes a gate member pivotally mounted for pivotable movement between said aperture open and aperture closed positions, biasing means to normally bias said gate member to said aperture closed position, said gate member including a projecting portion for engagement by a gate opening member, said operating means including said gate opening member, gear means to operate said gate opening member, said power means including a battery power supply to power an electric motor and an electric motor to drive said gear means, an operating and control circuit connected between said electric motor and said battery power supply to energize said motor upon receipt of a said signal by said remote control receiver from said remote control transmitter, said remote control receiver being connected in said operating and control circuit, including limit switch means to interrupt said operating and control circuit and stop said motor after a determined movement of said gear means, said gear means includes a planar gear having a planar surface, a first annular contact path extending around said planar surface of said planar gear, a second annular contact path extending around said planar surface of said planar gear spaced apart radially from said first annular contact path and concentric therewith, said first annular contact path being continuously electrically conductive throughout its entire circumference, said second annular contact path having a first arcuate portion which is electrically conductive and a second arcuate portion which is electrically non-conductive, a first electrical contact in continuous contact with said first annular contact path as said planar gear rotates, a second electrical contact in continuous contact with said second annular contact path as said planar gear rotates, said first and second electrical contacts being connected in a disconnect circuit, including said disconnect circuit, said disconnect circuit being completed and energized when said second electrical contact is in contact with said first electrical conductive arcuate portion of said second annular contact path and being interrupted and de-energized when said second contact is in contact with said second non-conductive arcuate portion of said second annular contact path, said limit switch means being in said disconnect circuit and connected to interrupt said operating and control circuit and stop said motor when said planar gear rotates said first conductive arcuate portion of said second annular contact path into contact with said second electrical contact.

2. An aerodynamic disk and carried member as set forth in claim 1, wherein said limit switch means includes an electrical relay comprising an induction coil and an electrical switch responsive thereto, said electrical switch being connected in said operating and control circuit and being normally biased to a contact closed position, said switch being movable to the contact open position upon energization of said induction coil of said relay responsive to energization of said disconnect circuit.

3. An aerodynamic disk and carried member as set forth in claim 2, wherein all of the said components of said remote controlled separation means and said carried member are encased in a housing, including said housing, said housing being connected to said downwardly facing surface of said disk and axially aligned therewith.

4. An aerodynamic disk and carried member as set forth in claim 2, wherein said disk includes a thickened central wall portion, all of the said components of said remote control separation means and said carried member are encased in a housing, including said housing being connected to said downwardly facing surface of said disk and axially aligned therewith.

5. An aerodynamic disk and carried member as set forth in claim 1, said carried member comprising an enclosure, said disk comprising a circular wall having a peripheral edge portion of arcuate cross-section and a thickened central portion, said thickened central portion of said disk wall including a wall cavity therein, said enclosure being received in said wall cavity, said enclosure having a chamber to receive and hold items for flight with said disk.

6. An aerodynamic disk and carried member as set forth in claim 5, wherein said peripheral edge portion of arcuate cross-section includes an outer convex surface and an inner concave surface, said inner concave surface and said outer convex surface diverging from each other as they extend radially inwardly from the peripheral edge of said circular wall to said thickened central portion.

7. An aerodynamic disk for flight through the air having an upwardly facing surface which faces generally upward and away from the earth during flight and a downwardly facing surface which faces generally downward and toward the earth during flight and a carried member carried by said disk during flight and separable therefrom during flight, remote controlled separation means to separate said carried member from said disk on command during flight, and remote control transmitting means to command said separation means to separate said carried member from said disk during flight, said remote control transmitting means including signal transmitting means able to transmit an operable signal a predetermined distance corresponding to the distance said disk travels during said flight, wherein said remote controlled separation means includes a discharge chamber to hold said carried member, said discharge chamber including a discharge aperture for discharge of said carried member from said discharge chamber on command from said remote control means.

8. An aerodynamic disk and carried member as set forth in claim 7, wherein said remote controlled separation means includes retention and discharge means movable between an aperture closed and aperture open position to respectively retain said carried member in said discharge chamber when in said aperture closed position and discharge said carried member from said discharge chamber when in said aperture open position.

9. An aerodynamic disk and carried member as set forth in claim 8, wherein said remote controlled separation means includes operating means to move said retention and discharge means between said aperture closed and aperture open positions, power means to drive said operating means, and a remote control receiver to start said power means and initiate operation of said operating means, said signal transmitting means including a remote control sound wave transmitter operable to transmit a sound wave signal to said remote control receiver.

10. An aerodynamic disk and carried member as set forth in claim 9, wherein said remote controlled separation means is carried on said aerodynamic disk for discharge of said carried member from said downwardly facing surface to fall by gravity to the earth.

11. An aerodynamic disk and carried member as set forth in claim 9, wherein said retention and discharge means includes a gate member pivotally mounted for pivotable movement in two opposite directions of rotation between said aperture closed and aperture open positions, biasing means to normally bias said gate member to said aperture closed position, said gate member including a projecting portion for engagement by a gate opening member, said operating means including said gate opening member, gear means to operate said gate opening member, said power means including a battery power supply to power an electrical motor and an electric motor to drive said gear means, an operating and control circuit connected between said electric motor and said battery power supply to energize said motor upon receipt of a said signal by said remote control receiver from said remote control transmitter, said remote control receiver being connected in said operating and control circuit.

* * * * *